US008075355B2

(12) United States Patent
Giroux et al.

(10) Patent No.: US 8,075,355 B2
(45) Date of Patent: Dec. 13, 2011

(54) MARINE JET PROPULSION STEERING SYSTEM

(75) Inventors: Francois Giroux, Valcourt (CA); Richard Simard, St-Charles de Drummond (CA); Andre Denis, Sherbrooke (CA); Marc Schuler, Sherbrooke (CA)

(73) Assignee: Bombardier Recreational Products Inc., Valcourt (CA)

( * ) Notice: Subject to any disclaimer, the term of this patent is extended or adjusted under 35 U.S.C. 154(b) by 536 days.

(21) Appl. No.: 12/243,057

(22) Filed: Oct. 1, 2008

(65) Prior Publication Data

US 2010/0081348 A1 Apr. 1, 2010

(51) Int. Cl.
*B63H 11/113* (2006.01)

(52) U.S. Cl. ..... 440/42; 440/40; 440/43

(58) Field of Classification Search ..... 114/55.52; 440/38, 39, 40, 41, 42, 43
See application file for complete search history.

(56) References Cited

U.S. PATENT DOCUMENTS

| | | | | |
|---|---|---|---|---|
| 3,121,994 | A * | 2/1964 | Aldropp | 440/43 |
| 3,137,266 | A * | 6/1964 | Perrier et al. | 440/43 |
| 4,509,923 | A * | 4/1985 | Turnbull | 440/43 |
| 5,803,775 | A | 9/1998 | Henmi | |
| 6,508,187 | B2 | 1/2003 | Maeda et al. | |
| 6,675,730 | B2 | 1/2004 | Simard et al. | |
| 7,753,746 | B1 * | 7/2010 | Pesant | 440/42 |

* cited by examiner

*Primary Examiner* — Lars A Olson
(74) *Attorney, Agent, or Firm* — Osler, Hoskin & Harcourt LLP

(57) ABSTRACT

A marine jet propulsion system has a jet pump, a venturi connected to the jet pump, and a steering nozzle rotationally mounted relative to the venturi about a first axis. The steering nozzle has a central longitudinal axis. The first axis intersects the central longitudinal axis. A first link has a first end rotationally mounted relative to the venturi about a second axis. The first link has a second end disposed generally rearwardly from the first end of the first link. A second link has a first end rotationally mounted to the first link about a third axis and a second end rotationally mounted to the steering nozzle about a fourth axis. The third axis intersects the second end of the first link. A steering arm is connected to the first link. The axes are generally parallel to each other. A watercraft having the jet propulsion system is also disclosed.

19 Claims, 12 Drawing Sheets

MARINE JET PROPULSION STEERING SYSTEM

FIELD OF THE INVENTION

The present invention relates to marine jet propulsion steering systems and to watercraft having such systems.

BACKGROUND OF THE INVENTION

There exist many different ways to propel watercraft. One way is to use what is known as a jet propulsion system which is powered by an engine of the watercraft. The jet propulsion system typically consists of a jet pump which pressurizes water from the body of water and expels it through a venturi as a jet rearwardly of the watercraft to create thrust. Usually, a steering nozzle is pivotally mounted rearwardly of the venturi. The steering nozzle is operatively connected to a steering assembly of the watercraft which causes it to turn left or right to redirect the jet of water and thereby steer the watercraft.

As would be understood, the more the steering nozzle can be rotated relative to the venturi, the more maneuverable the watercraft can be. As can be seen in FIG. 13A, in most current jet propelled watercraft, the steering nozzle 300 is directly connected or integrally formed with a steering arm 302 disposed on one side of the steering nozzle 300. The steering arm 302 is connected to a push-pull cable 304 or other linear actuation mechanism, which is in turn connected to the steering input device (not shown) of the watercraft (i.e. steering handles or steering wheel). Turning the steering input device causes the push-pull cable 304 to translate, thereby causing the steering nozzle 300 to rotate about the axis 306. In FIG. 13A, the steering nozzle 300', steering arm 302', and push-pull cable 304' (i.e. the elements shown in dotted lines) illustrate the position of these elements when the steering input device is moved so as to cause the watercraft to turn left. As can be seen, moving the push-pull cable 304 by a distance D in the longitudinal direction of the watercraft turns the steering nozzle 300 by X degrees from a straight/neutral position (i.e. the angle between the central longitudinal axis 308 of the nozzle 300 in the straight ahead direction to the central longitudinal axis 308' from the central longitudinal axis 308' of the turned nozzle 300').

It was found that in some applications, it may be desirable to increase the amount of steering nozzle rotation for a given amount of rotation of the steering input device compared to that provided by the above described system. This increases the responsiveness of the steering system of the watercraft. This also has the added benefit of increasing the maximum angle of rotation of the nozzle while maintaining the amount of rotation of the steering input device within a range that is comfortable to the driver.

Therefore, there is a need for a system which increases the amount of steering nozzle rotation for a given amount of rotation of the steering input device as compared to the steering system described above.

There is also a need for a watercraft having such a system.

SUMMARY OF THE INVENTION

It is an object of the present invention to ameliorate at least some of the inconveniences present in the prior art.

It is also an object of the present invention to provide a marine jet propulsion system having a mechanism which causes the steering nozzle of the propulsion system to be steered by a greater angle than in prior art propulsion systems for an equivalent displacement of a steering actuator (a push-pull cable for example).

It is another object of the present invention to provide a watercraft having the above-described marine jet propulsion system.

It is another object of the present invention to provide a marine jet propulsion system having a four bar linkage connecting the steering nozzle to the steering arm.

In one aspect, the invention provides a watercraft having a hull, a deck disposed on the hull, an engine supported by the hull, a jet pump connected to the hull and being operatively connected to the engine, a venturi connected to the jet pump, and a steering nozzle rotationally mounted relative to the venturi about a first axis. The steering nozzle has a central longitudinal axis. The first axis intersects the central longitudinal axis. A first link has a first end rotationally mounted relative to the venturi about a second axis. The first link has a second end disposed generally rearwardly from the first end of the first link. A second link has a first end rotationally mounted to the first link about a third axis and a second end rotationally mounted to the steering nozzle about a fourth axis. The third axis intersects the second end of the first link. A steering arm connects to the first link. A steering assembly is disposed at least in part on the deck and is operatively connected to the steering arm for rotating the steering nozzle relative to the venturi about the first axis. The first, second, third, and fourth axes are generally parallel to each other.

In an additional aspect, the fourth axis intersects the central longitudinal axis.

In a further aspect, a distance from the first axis to the second axis is equal to a distance from the third axis to the fourth axis regardless of a position of the steering nozzle relative to the venturi, and a distance from the first axis to the fourth axis is equal to a distance from the second axis to the third axis regardless of the position of the steering nozzle relative to the venturi. A line passing through the first and second axes is parallel to a line passing through the third and fourth axes regardless of the position of the steering nozzle relative to the venturi, and a line passing through the first and fourth axes is parallel to a line passing through the second and third axes regardless of the position of the steering nozzle relative to the venturi.

In an additional aspect, the steering assembly is operatively connected to the steering arm at a point. A distance from the second axis to an axis parallel to the second axis and passing through the point is smaller than a distance from the first axis to the axis passing through the point.

In a further aspect, a bracket is mounted to one of the jet pump, the venturi, and the hull. The steering nozzle is rotationally mounted to the bracket about the first axis and the first end of the first link is rotationally mounted to the bracket about the second axis.

In an additional aspect, the bracket is a trim support rotationally mounted relative to the venturi about a trim axis. The trim axis extends generally laterally and horizontally. The first, second, third, and fourth axes are rotatable about the trim axis with the trim support.

In a further aspect, the bracket is a first bracket, and the watercraft also has a second bracket rotationally mounted to the first bracket about the second axis. The first link and the steering arm are connected to the second bracket.

In an additional aspect, the first and second links are disposed generally vertically above the steering nozzle. A third link has a first end rotationally mounted relative to the venturi about the second axis. The third link has a second end disposed generally rearwardly from the first end of the third link.

A fourth link has a first end rotationally mounted to the third link about the third axis and a second end rotationally mounted to the steering nozzle about the fourth axis. The third and fourth links are disposed generally vertically below the steering nozzle.

In a further aspect, a bracket is rotationally mounted relative to the venturi about the second axis. The first link, the third link, and the steering arm are connected to the bracket.

In an additional aspect, the first link, the third link, and the steering arm are integrally formed.

In a further aspect, a bracket is rotationally mounted relative to the venturi about the second axis. The first link and the steering arm are connected to the bracket.

In another aspect, the invention provides a marine jet propulsion system having a jet pump, a venturi connected to the jet pump, and a steering nozzle rotationally mounted relative to the venturi about a first axis. The steering nozzle has a central longitudinal axis. The first axis intersects the central longitudinal axis. A first link has a first end rotationally mounted relative to the venturi about a second axis. The first link has a second end disposed generally rearwardly from the first end of the first link. A second link has a first end rotationally mounted to the first link about a third axis and a second end rotationally mounted to the steering nozzle about a fourth axis. The third axis intersects the second end of the first link. A steering arm is connected to the first link. The first, second, third, and fourth axes are generally parallel to each other.

In an additional aspect, the fourth axis intersects the central longitudinal axis.

In a further aspect, a distance from the first axis to the second axis is equal to a distance from the third axis to the fourth axis regardless of a position of the steering nozzle relative to the venturi, and a distance from the first axis to the fourth axis is equal to a distance from the second axis to the third axis regardless of the position of the steering nozzle relative to the venturi. A line passing through the first and second axes is parallel to a line passing through the third and fourth axes regardless of the position of the steering nozzle relative to the venturi, and a line passing through the first and fourth axes is parallel to a line passing through the second and third axes regardless of the position of the steering nozzle relative to the venturi.

In an additional aspect, the steering arm has a point for operatively connecting the steering arm to a steering assembly of a watercraft. A distance from the second axis to an axis parallel to the second axis and passing through the point is smaller than a distance from the first axis to the axis passing through the point.

In a further aspect, a trim support is rotationally mounted relative to the venturi about a trim axis. The trim axis extends generally laterally and horizontally. The steering nozzle is rotationally mounted to the bracket about the first axis and the first end of the first link is rotationally mounted to the bracket about the second axis. The first, second, third, and fourth axes are rotatable about the trim axis with the trim support.

In an additional aspect, the first and second links are disposed generally vertically above the steering nozzle. A third link has a first end rotationally mounted relative to the venturi about the second axis. The third link has a second end disposed generally rearwardly from the first end of the third link. A fourth link has a first end rotationally mounted to the third link about the third axis and a second end rotationally mounted to the steering nozzle about the fourth axis. The third and fourth links are disposed generally vertically below the steering nozzle.

In a further aspect, a bracket is rotationally mounted relative to the venturi about the second axis. The first link and the steering arm are connected to the bracket.

In yet another aspect, the invention provides a marine jet propulsion system having a jet pump, a venturi connected to the jet pump, a steering nozzle rotationally mounted relative to the venturi, a four bar linkage connecting the steering nozzle to the venturi, and a steering arm connected to the four bar linkage.

In an additional aspect, the four bar linkage is a parallelogram linkage.

For purposes of this application, terms related to spatial orientation such as forwardly, rearwardly, left, and right, are as they would normally be understood by a driver of the watercraft sitting thereon in a normal driving position. It should be understood that terms related to spatial orientation when referring to the jet propulsion system or the steering nozzle assembly should be understood as they would normally be understood when the jet propulsion system or the steering nozzle assembly is installed on a watercraft.

Embodiments of the present invention each have at least one of the above-mentioned objects and/or aspects, but do not necessarily have all of them. It should be understood that some aspects of the present invention that have resulted from attempting to attain the above-mentioned objects may not satisfy these objects and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION OF THE PREFERRED EMBODIMENTS

The present invention will be described with respect to a personal watercraft and a jet boat. However, it should be understood that other types of watercraft are contemplated.

The general construction of a personal watercraft 10 in accordance with aspects of this invention will be described with respect to FIGS. 1-5. The following description relates to one way of manufacturing a personal watercraft. Obviously, those of ordinary skill in the watercraft art will recognize that there are other known ways of manufacturing and designing watercraft and that this invention would encompass other known ways and designs.

Figure 1:
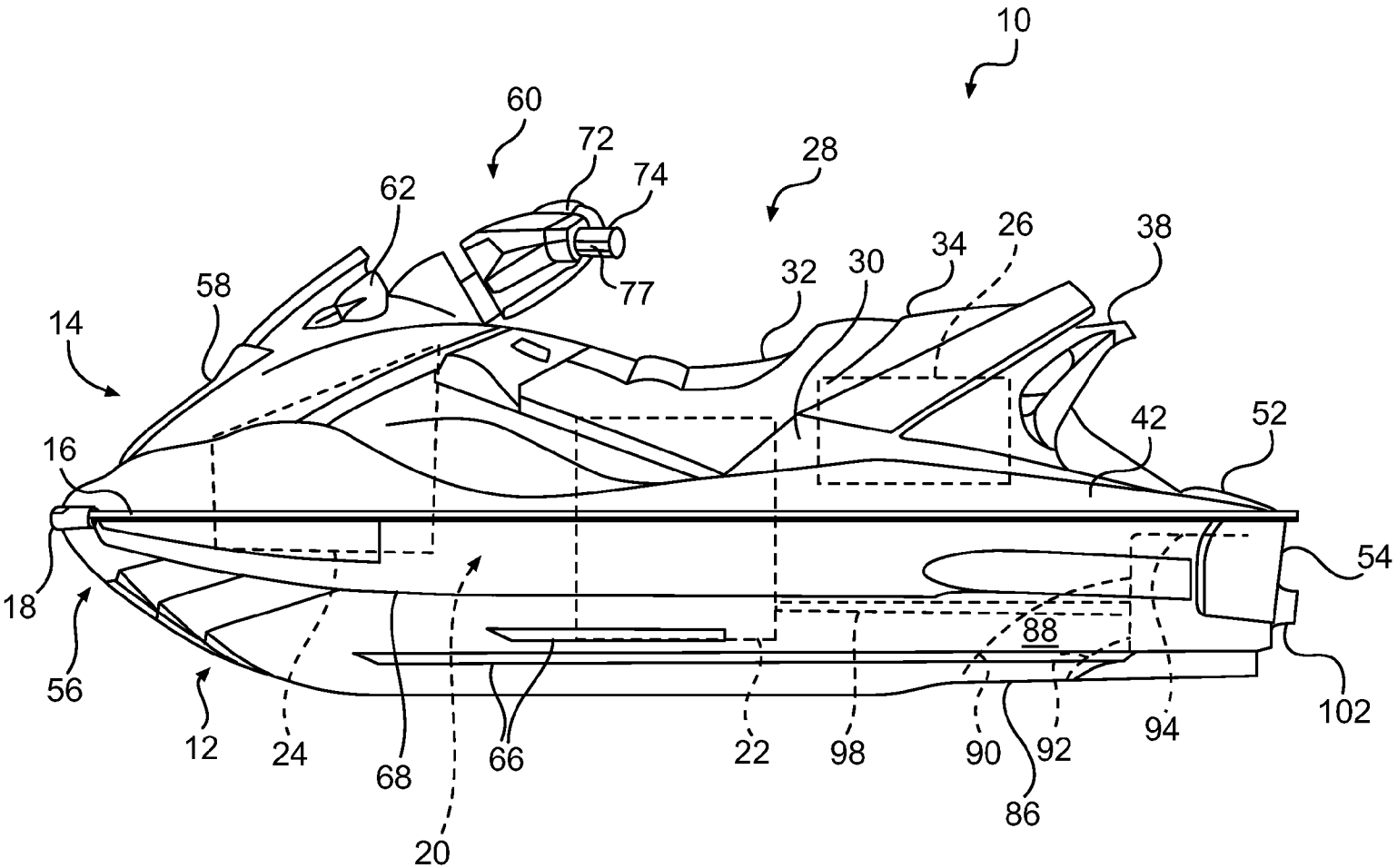
FIG. 1 illustrates a side view of a personal watercraft in accordance with aspects of the invention.

The watercraft 10 of FIG. 1 is made of two main parts, including a hull 12 and a deck 14. The hull 12 buoyantly supports the watercraft 10 in the water. The deck 14 is designed to accommodate a rider and one or more passengers. The hull 12 and deck 14 are joined together at a seam 16 that joins the parts in a sealing relationship. Preferably, the seam 16 comprises a bond line formed by an adhesive. Of course, other known joining methods could be used to sealingly engage the parts together, including but not limited to thermal fusion, molding or fasteners such as rivets or screws. A bumper 18 generally covers the seam 16, which helps to prevent damage to the outer surface of the watercraft 10 when the watercraft 10 is docked for example. The bumper 18 can extend around the bow 56, as shown, or around any portion or all of the seam 16.

The space between the hull 12 and the deck 14 forms a volume commonly referred to as the engine compartment 20. Shown schematically in FIG. 1, the engine compartment 20 accommodates an engine 22, as well as an exhaust system, fuel supply system, electrical system (battery, electronic control unit, etc.), air intake system, storage bins 24, 26, and other elements required or desirable in the watercraft 10.

Figure 2:
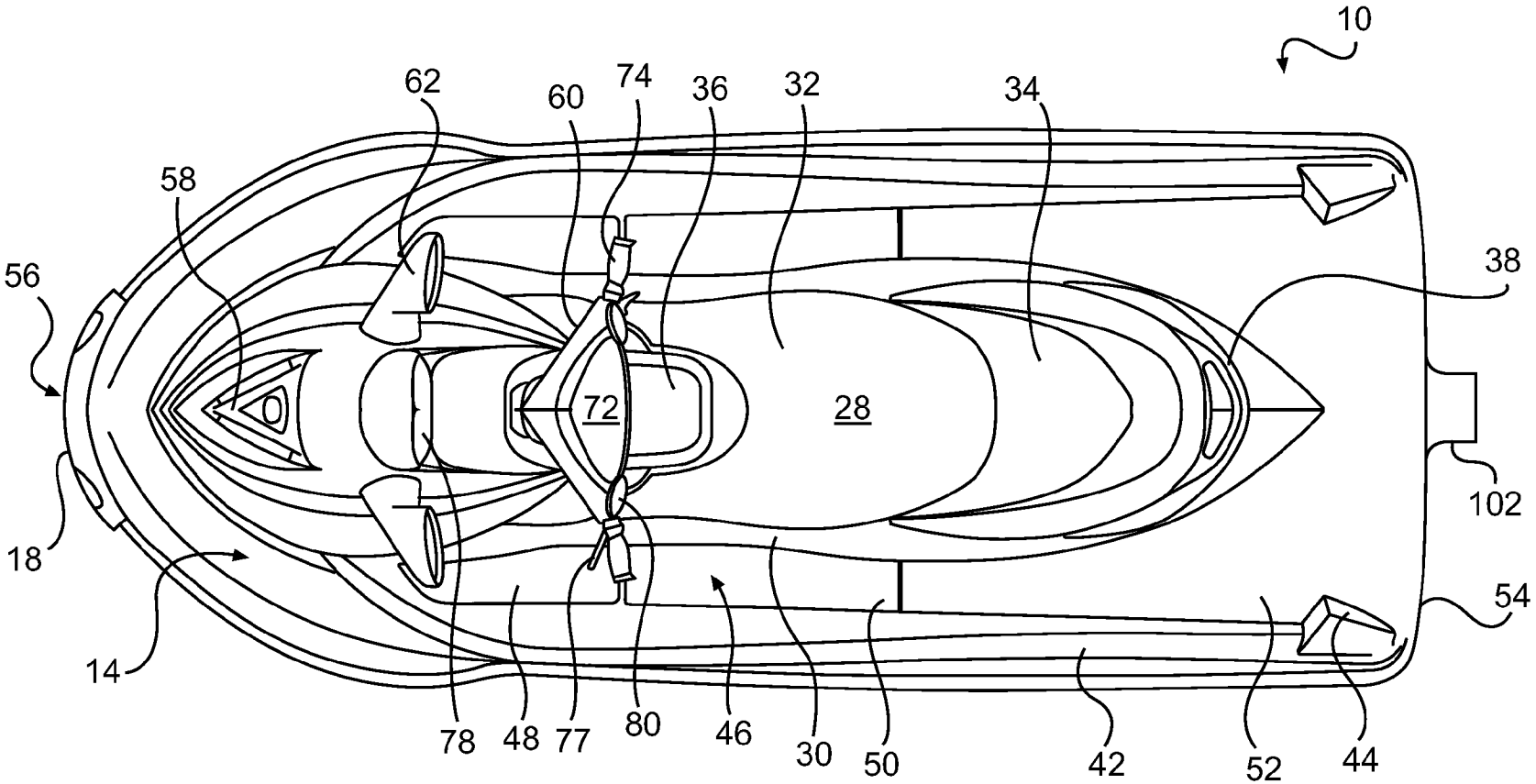
FIG. 2 is a top view of the watercraft of FIG. 1.

As seen in FIGS. 1 and 2, the deck 14 has a centrally positioned straddle-type seat 28 positioned on top of a pedestal 30 to accommodate a rider in a straddling position. The seat 28 is sized to accommodate one or more riders. As seen in FIG. 2, the seat 28 includes a first, front seat portion 32 and a rear, raised seat portion 34 that accommodates a passenger. The first and second seat portions 32, 34 are removably attached to the pedestal 30 by a hook and tongue assembly (not shown) at the front of each seat portion and by a latch assembly (not shown) at the rear of each seat portion, or by any other known attachment mechanism. The seat portions 32, 34 can be individually tilted or removed completely. The seat portion 32 covers an engine access opening (in this case above engine 22) defined by a top portion of the pedestal 30 to provide access to the engine 22 (FIG. 1). The seat portion 34 covers a removable storage box 26 (FIG. 1). A "glove compartment" or small storage box 36 is provided in front of the seat 28.

Figure 4:
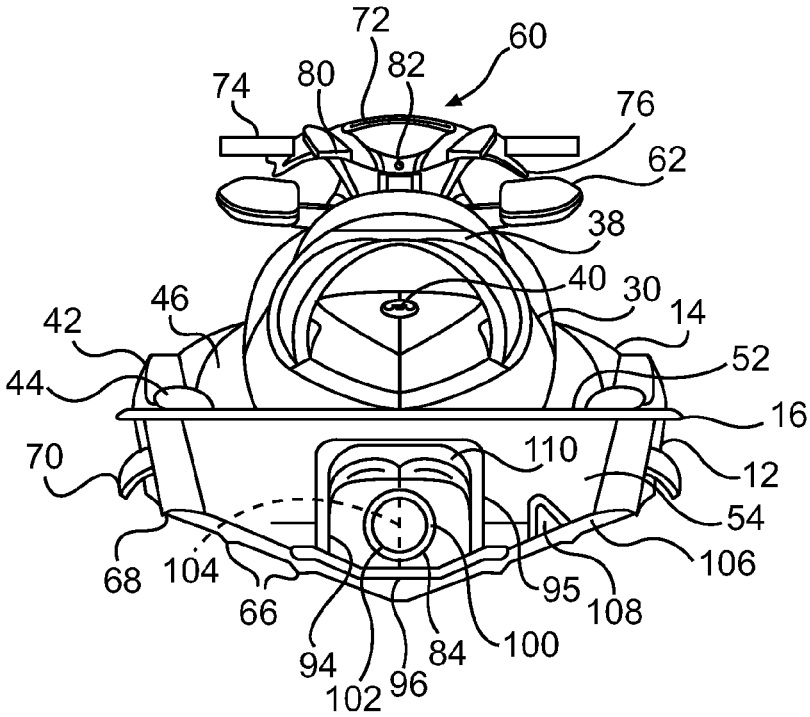
FIG. 4 is a back view of the watercraft of FIG. 1.

As seen in FIG. 4, a grab handle 38 is provided between the pedestal 30 and the rear of the seat 28 to provide a handle onto which a passenger may hold. This arrangement is particularly convenient for a passenger seated facing backwards for spotting a water skier, for example. Beneath the handle 38, a tow hook 40 is mounted on the pedestal 30. The tow hook 40 can be used for towing a skier or floatation device, such as an inflatable water toy.

As best seen in FIGS. 2 and 4 the watercraft 10 has a pair of generally upwardly extending walls located on either side of the watercraft 10 known as gunwales or gunnels 42. The gunnels 42 help to prevent the entry of water in the footrests 46 of the watercraft 10, provide lateral support for the rider's feet, and also provide buoyancy when turning the watercraft 10, since personal watercraft roll slightly when turning. Towards the rear of the watercraft 10, the gunnels 42 extend inwardly to act as heel rests 44. Heel rests 44 allow a passenger riding the watercraft 10 facing towards the rear, to spot a water-skier for example, to place his or her heels on the heel rests 44, thereby providing a more stable riding position. Heel rests 44 could also be formed separate from the gunnels 42.

Located on both sides of the watercraft 10, between the pedestal 30 and the gunnels 42 are the footrests 46. The footrests 46 are designed to accommodate a rider's feet in various riding positions. To this effect, the footrests 46 each have a forward portion 48 angled such that the front portion of the forward portion 48 (toward the bow 56 of the watercraft 10) is higher, relative to a horizontal reference point, than the rear portion of the forward portion 48. The remaining portions of the footrests 46 are generally horizontal. Of course, any contour conducive to a comfortable rest for the rider could be used. The footrests 46 are covered by carpeting 50 made of a rubber-type material, for example, to provide additional comfort and traction for the feet of the riders.

A reboarding platform 52 is provided at the rear of the watercraft 10 on the deck 14 to allow the rider or a passenger to easily reboard the watercraft 10 from the water. Carpeting or some other suitable covering covers the reboarding platform 52. A retractable ladder (not shown) may be affixed to the transom 54 to facilitate boarding the watercraft 10 from the water onto the reboarding platform 52.

Figure 3:
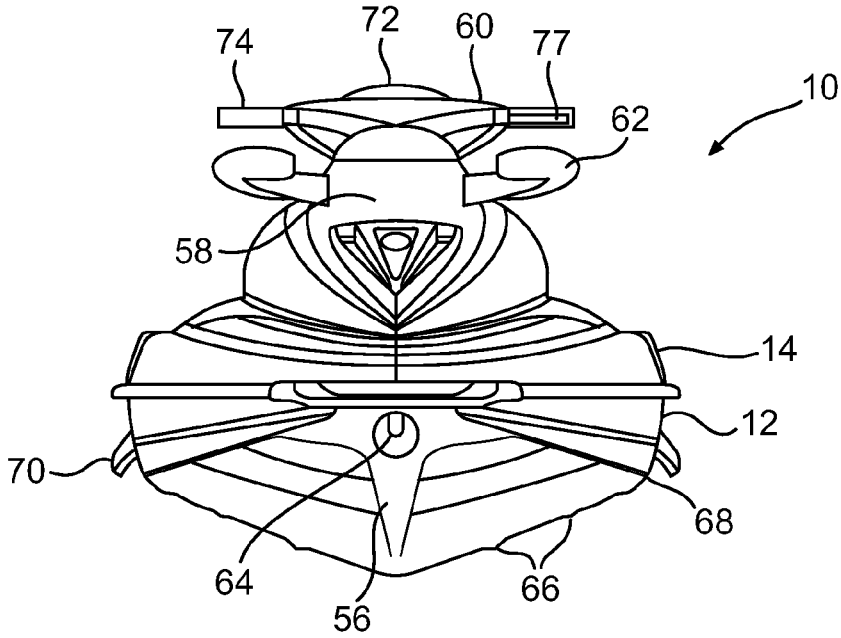
FIG. 3 is a front view of the watercraft of FIG. 1.

Referring to the bow 56 of the watercraft 10, as seen in FIGS. 2 and 3, watercraft 10 is provided with a hood 58 located forwardly of the seat 28 and a steering assembly including a helm assembly 60. A hinge (not shown) is attached between a forward portion of the hood 58 and the deck 14 to allow hood 58 to move to an open position to provide access to the front storage bin 24 (FIG. 1). A latch (not shown) located at a rearward portion of hood 58 locks hood 58 into a closed position. When in the closed position, hood 58 prevents water from entering front storage bin 24. Rearview mirrors 62 are positioned on either side of hood 58 to allow the rider to see behind the watercraft 10. A hook 64 is located at the bow 56 of the watercraft 10. The hook 64 is used to attach the watercraft 10 to a dock when the watercraft is not in use or to attach to a winch when loading the watercraft 10 on a trailer, for instance.

Figure 5:
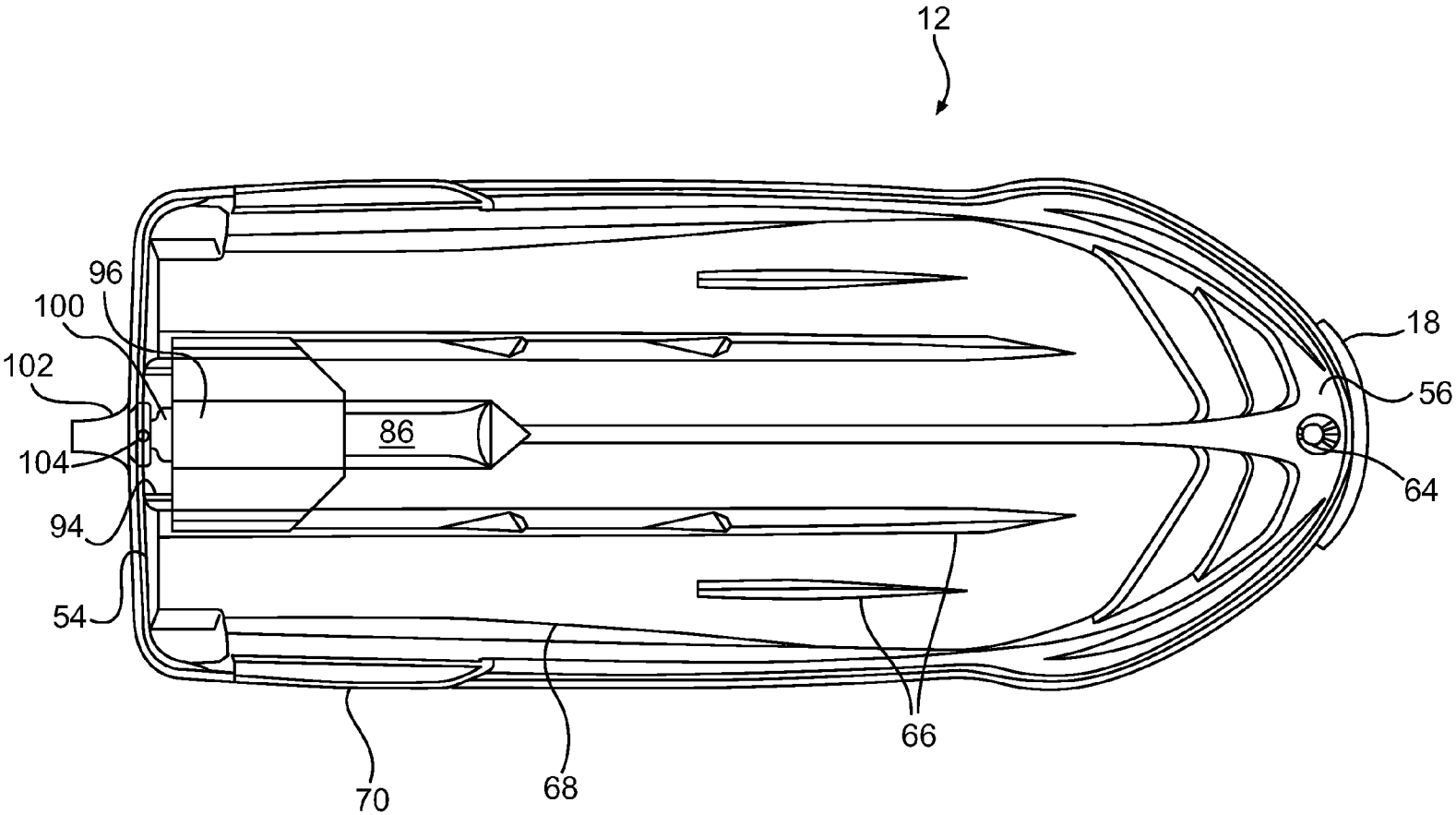
FIG. 5 is a bottom view of the hull of the watercraft of FIG. 1.

As best seen in FIGS. 3, 4, and 5, the hull 12 is provided with a combination of strakes 66 and chines 68. A strake 66 is a protruding portion of the hull 12. A chine 68 is the vertex formed where two surfaces of the hull 12 meet. The combination of strakes 66 and chines 68 provide the watercraft 10 with its riding and handling characteristics.

Sponsons 70 are located on both sides of the hull 12 near the transom 54. The sponsons 70 have an arcuate undersurface that gives the watercraft 10 both lift while in motion and improved turning characteristics. The sponsons 70 are preferably fixed to the surface of the hull 12 and can be attached to the hull 12 by fasteners or molded therewith. Sometimes it may be desirable to adjust the position of the sponsons 70 with respect to the hull 12 to change the handling characteristics of the watercraft 10 and accommodate different riding conditions.

As best seen in FIGS. 3 and 4, the helm assembly 60 is positioned forwardly of the seat 28. The helm assembly 60 has a central helm portion 72, that may be padded, and a pair of steering handles 74, also referred to as a handlebar. One of the steering handles 74 is provided with a throttle operator 76, which allows the rider to control the engine 22, and therefore the speed of the watercraft 10. The throttle operator 76 can be in the form of a thumb-actuated throttle lever (as shown), a finger-actuated throttle lever, or a twist grip. The throttle operator 76 is movable between an idle position and multiple actuated positions. The throttle operator 76 is preferably biased towards the idle position, such that when the driver of the watercraft lets go of the throttle operator 76, it will move to the idle position. The other of the steering handles 74 is provided with a lever 77 used by the driver to control one of a reverse gate 110 and trim of the watercraft 10.

As seen in FIG. 2, a display area or cluster 78 is located forwardly of the helm assembly 60. The display cluster 78 can be of any conventional display type, including a liquid crystal display (LCD), dials or LEDs (light emitting diodes). The central helm portion 72 has various buttons 80, which could alternatively be in the form of levers or switches, that allow the rider to modify the display data or mode (speed, engine rpm, time . . . ) on the display cluster 78.

The helm assembly 60 also has a key receiving post 82, preferably located near a center of the central helm portion 72. The key receiving post 82 is adapted to receive a key (not shown) that is used to allow starting of the watercraft 10. As is known, the key is typically attached to a safety lanyard (not shown). It should be noted that the key receiving post 82 may be placed in any suitable location on the watercraft 10.

Returning to FIGS. 1 and 5, it can be seen that the watercraft 10 is propelled by a jet propulsion system 84. The jet propulsion system 84 pressurizes water to create thrust. The water is first scooped from under the hull 12 through an inlet 86, which preferably has a grate (not shown in detail). The inlet grate prevents large rocks, weeds, and other debris from entering the jet propulsion system 84, which may damage the system or negatively affect performance. Water flows from the inlet 86 through a water intake ramp 88. The top portion 90 of the water intake ramp 88 is formed by the hull 12, and a ride shoe (not shown in detail) forms its bottom portion 92. Alternatively, the intake ramp 88 may be a single piece or an insert to which the jet propulsion system 84 attaches. In such cases, the intake ramp 88 and the jet propulsion system 84 are attached as a unit in a recess in the bottom of hull 12.

From the intake ramp 88, water enters the jet propulsion system 84. The jet propulsion system 84 is located in a formation in the hull 12, referred to as the tunnel 94 (FIG. 1). The tunnel 94 is defined at the front, sides, and top by walls formed by the hull 12 and is opened at the transom 54. The bottom of the tunnel 94 is closed by a ride plate 96. The ride plate 96 creates a surface on which the watercraft 10 rides or planes at high speeds.

Figure 8:
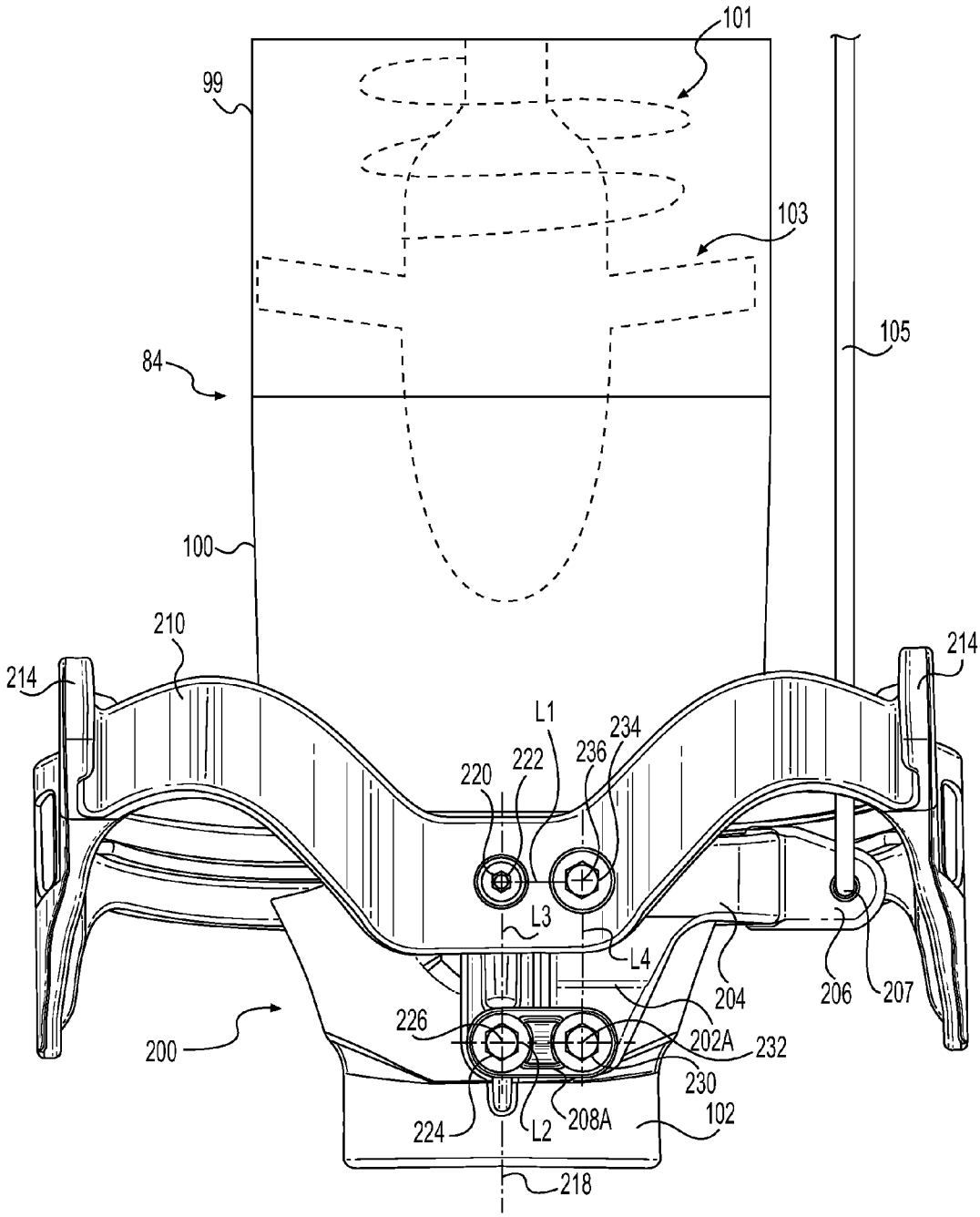
FIG. 8 is a top plan view of a jet propulsion system for the personal watercraft of FIG. 1 or the jet boat of FIG. 6 as arranged when the watercraft or jet boat is not being steered.

The jet propulsion system 84 includes a jet pump 99 (see FIG. 8). The forward end of the jet pump 99 is connected to the front wall of the tunnel 94. The jet pump 99 includes an impeller 101 and a stator 103 (FIG. 8). The impeller 101 is coupled to the engine 22 by one or more shafts 98 (FIG. 1), such as a driveshaft and an impeller shaft. The rotation of the impeller 101 pressurizes the water, which then moves over the stator 103 that is made of a plurality of fixed stator blades. The role of the stator blades is to decrease the rotational motion of the water so that almost all the energy given to the water is used for thrust, as opposed to swirling the water. Once the water leaves the jet pump 99, it goes through a venturi 100 that is connected to the rearward end of the jet pump 99. Since the venturi's exit diameter is smaller than its entrance diameter, the water is accelerated further, thereby providing more thrust. A steering nozzle 102 is rotationally mounted relative to the venturi 100, as described in greater detail below.

The steering nozzle 102 is operatively connected to the helm assembly 60 preferably via a push-pull cable 105, as described in greater detail below, such that when the helm assembly 60 is turned, the steering nozzle 102 pivots. This movement redirects the pressurized water coming from the venturi 100, so as to redirect the thrust and steer the watercraft 10 in the desired direction.

The jet propulsion system 84 is provided with a reverse gate 110 (FIG. 4) which is movable between a stowed position where it does not interfere with a jet of water being expelled by the steering nozzle 102 and a plurality of positions where it redirects the jet of water being expelled by the steering nozzle 102. The specific construction of the reverse gate 110 will not be described in detail herein. However it will be understood by those skilled in the art that many different types of reverse gate could be provided without departing from the present invention.

When the watercraft 10 is moving, its speed is measured by a speed sensor 106 attached to the transom 54 of the watercraft 10. The speed sensor 106 has a paddle wheel 108 that is turned by the water flowing past the hull 12. In operation, as the watercraft 10 goes faster, the paddle wheel 108 turns faster in correspondence. An electronic control unit (ECU) (not shown) connected to the speed sensor 106 converts the rotational speed of the paddle wheel 108 to the speed of the watercraft 10 in kilometers or miles per hour, depending on the rider's preference. The speed sensor 106 may also be placed in the ride plate 96 or at any other suitable position. Other types of speed sensors, such as pitot tubes, and processing units could be used, as would be readily recognized by one of ordinary skill in the art. Alternatively, a global positioning system (GPS) unit could be used to determine the speed of the watercraft 10 by calculating the change in position of the watercraft 10 over a period of time based on information obtained from the GPS unit.

Figure 6:
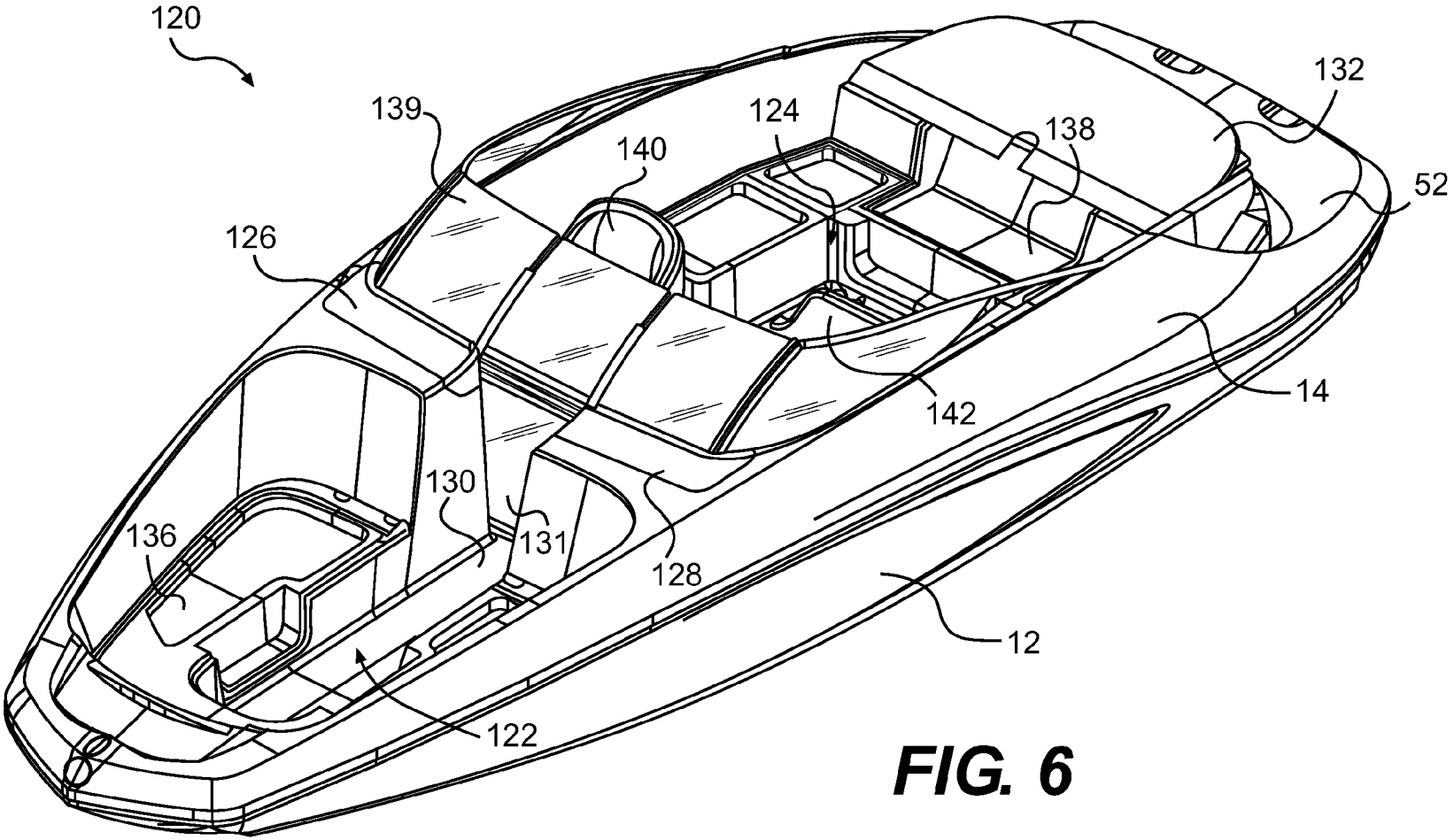
FIG. 6 is a perspective view, taken from a front, left side, of a jet boat in accordance with aspects of the invention.
Figure 7:
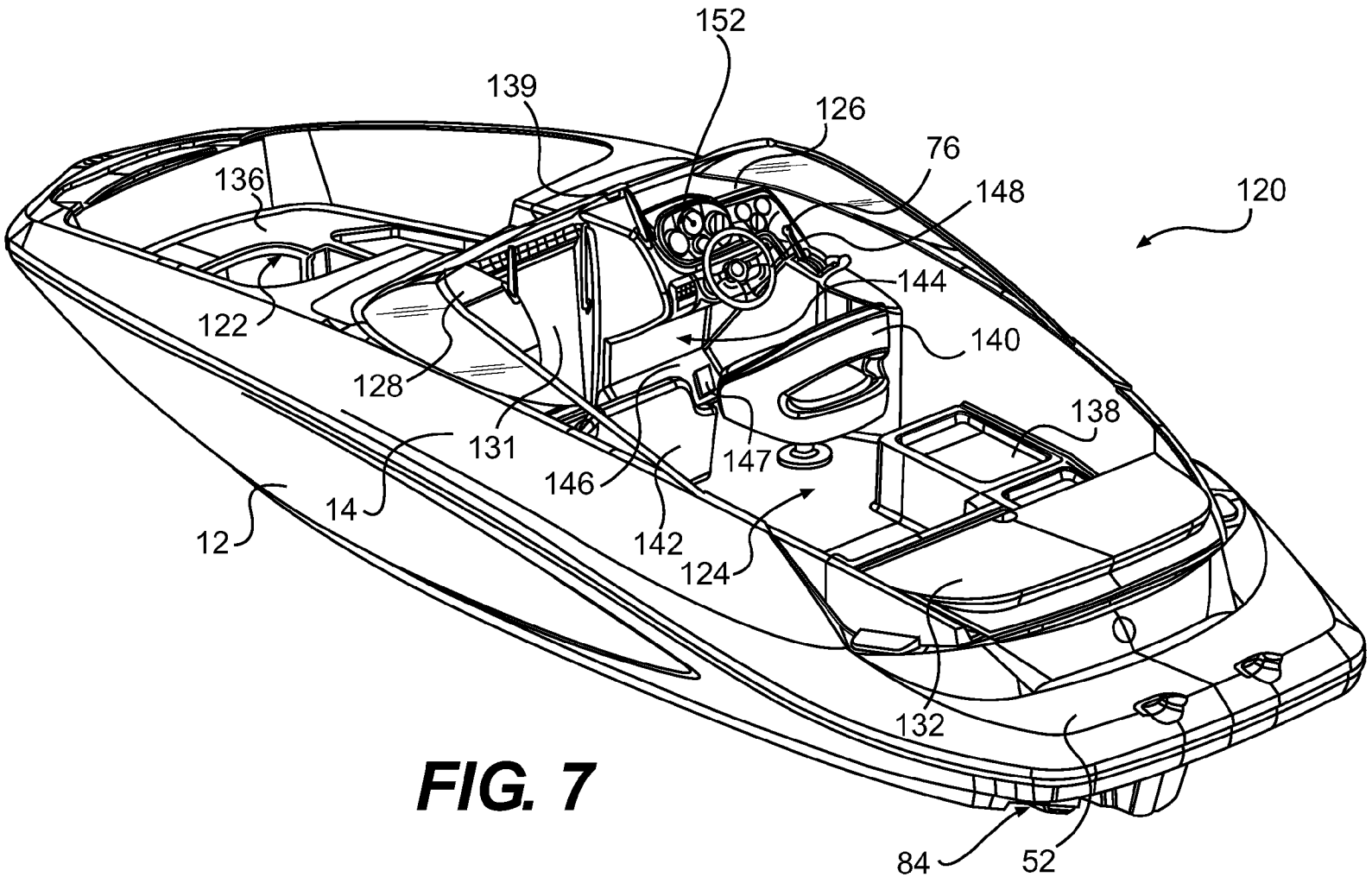
FIG. 7 is a perspective view, taken from a rear, left side, of the jet boat of FIG. 6.

The general construction of a jet boat 120 in accordance with aspects of this invention will now be described with respect to FIGS. 6 and 7. The following description relates to one way of manufacturing a jet boat. Obviously, those of ordinary skill in the jet boat art will recognize that there are other known ways of manufacturing and designing jet boats and that this invention would encompass other known ways and designs.

For simplicity, the components of the jet boat 120 which are similar in nature to the components of the personal watercraft 10 described above will be given the same reference numeral. It should be understood that their specific construction may vary however.

The jet boat 120 has a hull 12 and a deck 14 supported by the hull 12. The deck 14 has a forward passenger area 122 and a rearward passenger area 124. A right console 126 and a left console 128 are disposed on either side of the deck 14 between the two passenger areas 122, 124. A passageway 130 disposed between the two consoles 126, 128 allows for communication between the two passenger areas 122, 124. A door 131 is used to selectively open and close the passageway 130. At least one engine (not shown) is located between the hull 12 and the deck 14 at the back of the boat 120. The engine powers the jet propulsion system 84 of the boat 120. The jet propulsion system 84 is of similar construction as the jet propulsion system 84 of the personal watercraft 10 described above, and in greater detail below, and will therefore not be described in detail here. It is contemplated that the boat 120 could have two engines and two jet propulsion systems 84. The engine is accessible through an engine cover 132 located behind the rearward passenger area 124. The engine cover 132 can also be used as a sundeck for a passenger of the boat 120 to sunbathe on while the boat 120 is not in motion. A reboarding platform 52 is located at the back of the deck 14 for passengers to easily reboard the boat 120 from the water.

The forward passenger area 122 has a C-shaped seating area 136 for passengers to sit on. The rearward passenger area 124 also has a C-shaped seating area 138 at the back thereof. A driver seat 140 facing the right console 126 and a passenger seat 142 facing the left console 124 are also disposed in the rearward passenger area 124. It is contemplated that the driver and passenger seats 140, 142 can swivel so that the passengers occupying these seats can socialize with passengers occupying the C-shaped seating area 138. A windshield 139 is provided at least partially on the left and right consoles 124, 126 and forwardly of the rearward passenger area 124 to shield the passengers sitting in that area from the wind when the boat 120 is in movement. The right and left consoles 126, 128 extend inwardly from their respective side of the boat 120. At least a portion of each of the right and the left consoles 126, 128 is integrally formed with the deck 14. The right console 126 has a recess 144 formed on the lower portion of the back thereof to accommodate the feet of the driver sitting in the driver seat 140 and an angled portion of the right console 126 acts as a footrest 146. A foot pedal 147 is provided on the footrest 146 which may be used to control a reverse gate or a trim of the jet boat 120. The left console 128 has a similar recess (not shown) to accommodate the feet of the passenger sitting in the passenger seat 142. The right console 126 accommodates all of the elements necessary to the driver to operate the boat 120. These include, but are not limited to, a steering assembly including a steering wheel 148, a throttle operator 76 in the form of a throttle lever, and an instrument panel 152. The instrument panel 152 has various dials indicating the watercraft speed, engine speed, fuel and oil level, and engine temperature. The speed of the watercraft is measured by a speed sensor (not shown) which can be in the form of the speed sensor 106 described above with respect to the personal watercraft 10 or a GPS unit or any other type of speed sensor which could be used for marine applications. It is contemplated that the elements attached to the right console 126 could be different than those mentioned above. The left console 128 incorporates a storage compartment (not shown) which is accessible to the passenger sitting the passenger seat 142.

Turning now to FIG. 8, the jet propulsion system 84 will be described in more detail. As previously mentioned, the jet propulsion system 84 includes the jet pump 99, the venturi 100 which is connected to the jet pump 99, and the steering nozzle 102. The steering nozzle 102 is part of a steering nozzle assembly 200 which also includes links 202A, 202B, bracket 204, steering arm 206, and links 208A, 208B as described in greater detail below. The steering nozzle assembly 200 is connected to a bracket in the form of a trim support 210. However, as described below, it is contemplated that the steering nozzle assembly 200 could be connected to the venturi 100, the jet pump 99, or a portion of the hull 12 such as the tunnel 94.

Figure 9:
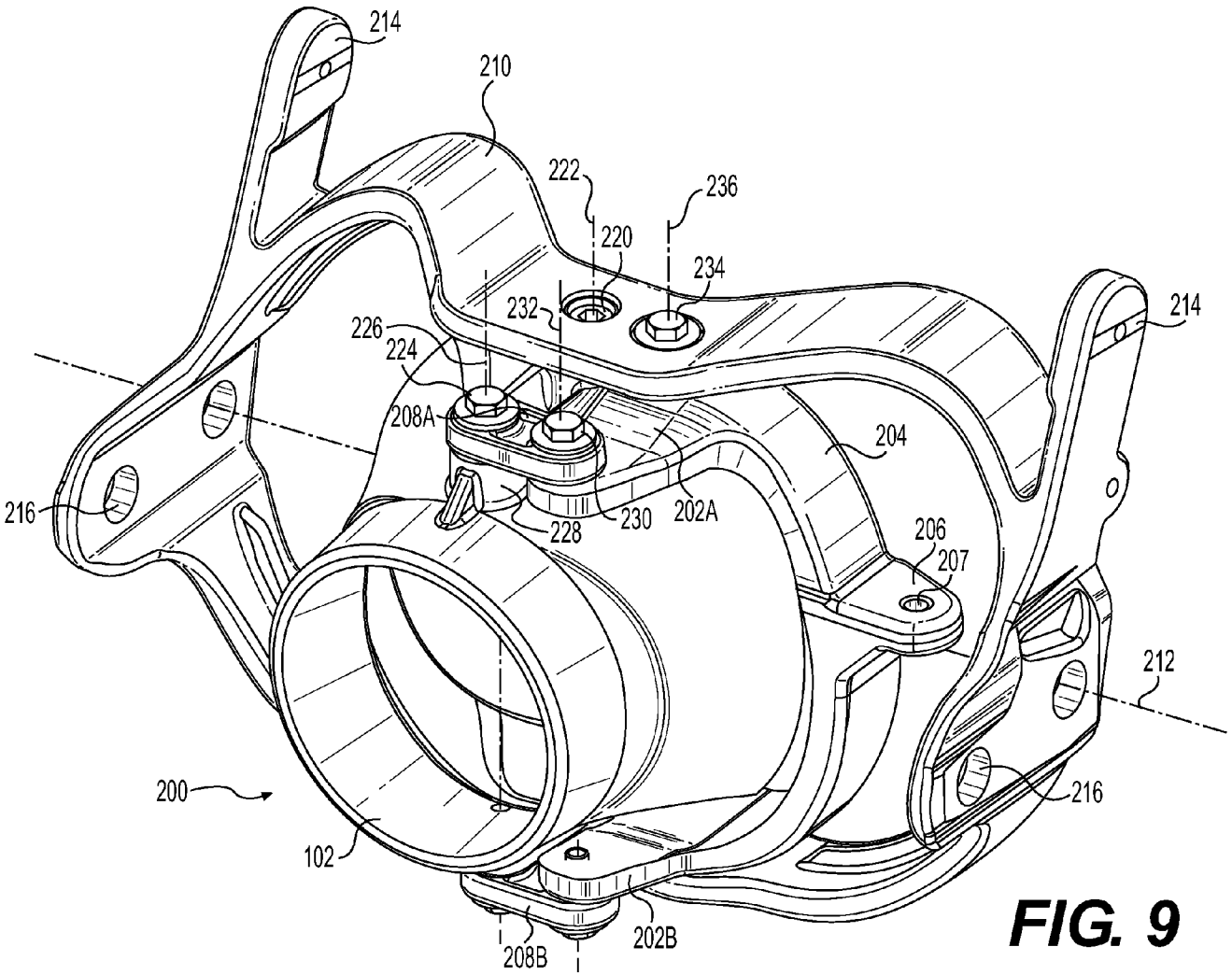
FIG. 9 is a perspective view, taken from a rear, right side, of a steering nozzle assembly and a trim support of the jet propulsion system of FIG. 8 as arranged when the watercraft or jet boat is not being steered.

Turning now to FIGS. 8 to 12 and 13B, the steering nozzle assembly 200 and the trim support 210 will be described in more detail. The trim support 210 is rotationally mounted to the tunnel 94 about a laterally and horizontally extending trim axis 212 (FIG. 9). It is contemplated that the trim support 210 could alternatively be mounted to the venturi 100, the ride plate 96, or the jet pump 99. The trim support 210 is provided with tabs 214 to which the trim actuator (not shown) is connected in order to rotate the trim support 210 about the trim axis 212. By rotating the trim support 210 about the trim axis 212, the steering nozzle 102 can be pointed upwardly or downwardly so as to adjust the pitch of the watercraft. As would be understood, all of the other elements of the steering nozzle assembly 200 also rotate about the trim axis 212 together with the steering nozzle 102. As best seen in FIG. 9, the trim support 210 is provided with apertures 216 to permit the attachment of the reverse gate 110.

As seen in FIG. 8, the steering nozzle 102 has a central longitudinal axis 218. The top of the steering nozzle 102 is rotationally mounted by a fastener 220 to the trim support 210 about an axis 222. The bottom of the steering nozzle 102 is similarly mounted about the axis 222. The axis 222 intersects the central longitudinal axis 218 and is generally perpendicular thereto. The axis 222 is the axis about which the steering nozzle 102 is steered. It is contemplated that the steering nozzle 102 could alternatively be rotationally mounted directly to the venturi 100 or a portion of the hull 12. The link 208A has one end rotationally mounted by a fastener 224 about an axis 226 to a boss 228 (FIG. 9) on the top of the steering nozzle 102. As can be seen, the axis 226 intersects the central longitudinal axis 218 rearwardly of the axis 222 and is generally parallel to the axis 222. It is contemplated that the axis 226 could be disposed to one side of the central longitudinal axis 218. The other end of the link 208A is rotationally mounted by a fastener 230 to the rear end of the link 202A about an axis 232. The axis 232 is disposed to one side of the central longitudinal axis 218 of the nozzle 102 and is generally parallel of the axes 222 and 226. The link 208B is similarly rotationally mounted about the axes 226 and 232 to the bottom of the steering nozzle 102 and the rear end of the link 202B. The forward end of the link 202A is rotationally mounted by a fastener 234 about an axis 236 to the trim support 210. The axis 236 is disposed to one side of the central longitudinal axis 218 of the nozzle 102 (the same side as axis 232) and is generally parallel to the axes 222, 226 and 232. The forward end of the link 202B is similarly rotationally mounted about the axis 236 to the trim support 210. It is contemplated that the forward end of one or both of the links 202A and 202B could alternatively be rotationally mounted to a portion of the hull 12 or to some other fixed bracket extending between the axes 222 and 236. The links 202A and 202B are connected via the bracket 204 to the steering arm 206. In the illustrated embodiment, the links 202A and 202B, the bracket 204, and the steering arm 206 are integrally formed such that the bracket 204 and the steering arm 206 are rotationally mounted about the axis 236. It is contemplated that the links 202A and 202B, the bracket 204, and the steering arm 206 could be connected otherwise, such as by welding for example. It is contemplated that one set of the links 202A and 208A and the links 202B and 208B could be omitted such that the steering arm 206 would only be connected to one of the top and the bottom of the steering nozzle 102. The push-pull cable 105 is connected to the steering arm 206 at point 207 so as to permit actuation of the steering nozzle assembly 200.

Figure 11:
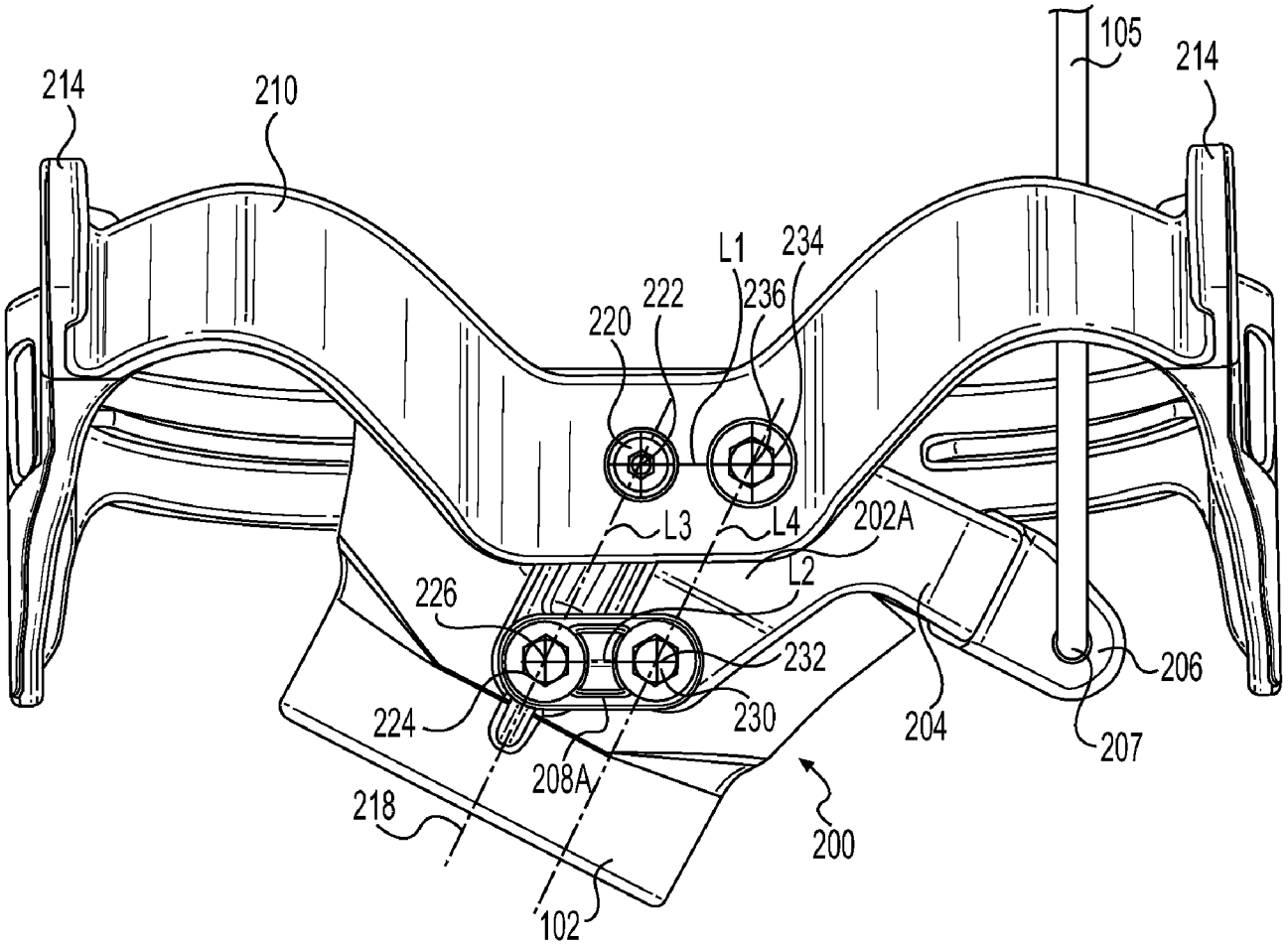
FIG. 11 is a top plan view of the steering nozzle assembly and the trim support of FIG. 9 as arranged when the watercraft or jet boat is being steered towards the left.
Figure 12:
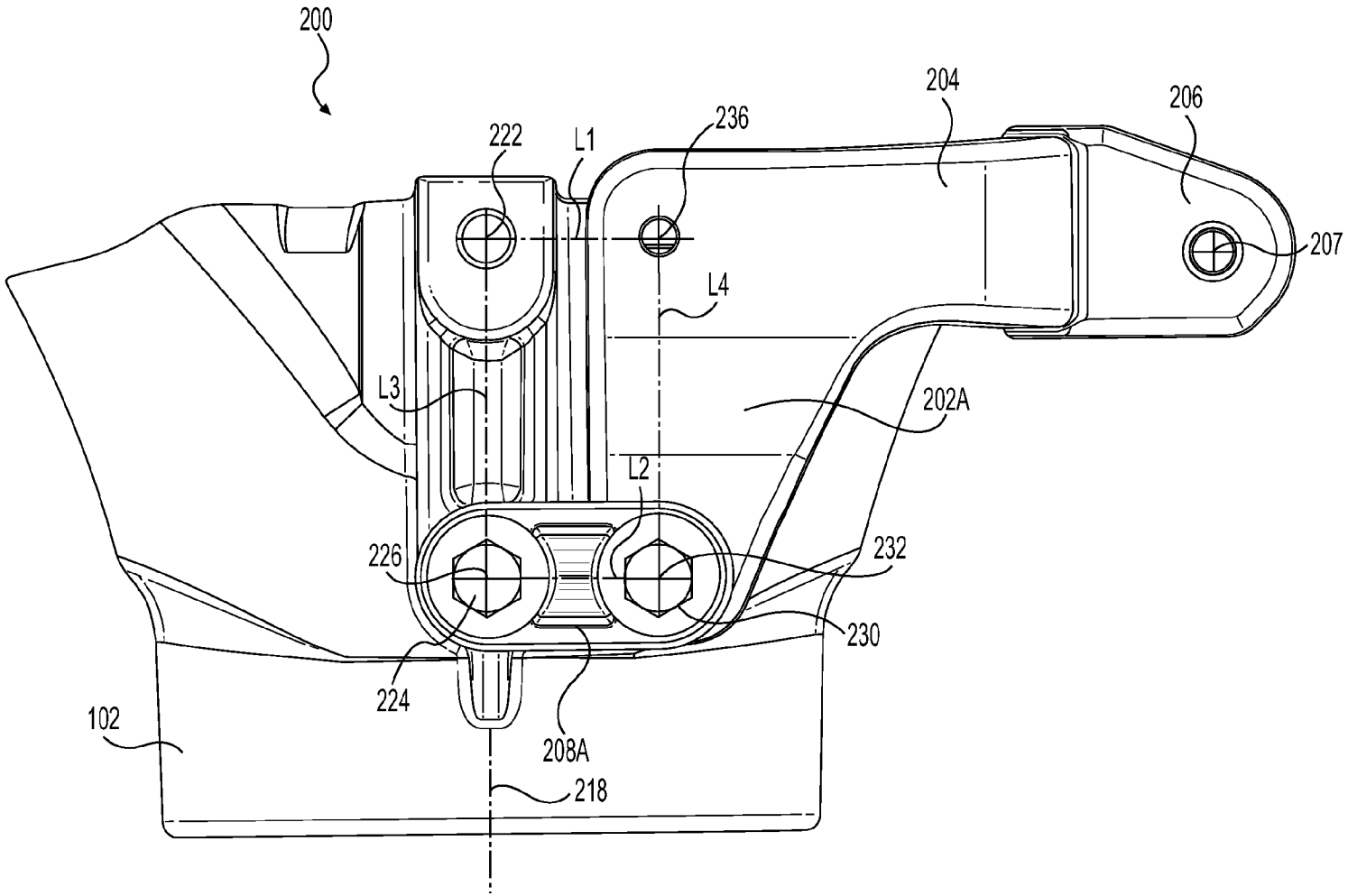
FIG. 12 is a top plan view of the steering nozzle assembly of FIG. 9 as arranged when the watercraft or jet boat is not being steered.

As best seen in FIG. 12, the distance between the axes 222 and 236 is equal to the distance between the axes 226 and 232 and a line L1 passing through the axes 222 and 236 is parallel to a line L2 passing through the axes 226 and 232. Also, the distance between the axes 222 and 226 is equal to the distance between the axes 232 and 236 and a line L3 passing through the axes 222 and 226 is equal to a line L4 passing through the axes 232 and 236. As can be seen by comparing FIGS. 8, 10, and 11, these distances remain the same, the line L1 remains parallel to the line L2, and the line L3 remains parallel to the line L4 regardless of the position of the steering nozzle 102. This arrangement results in the steering nozzle 102 being connected (although indirectly) to the venturi 100 by two four bar linkages (one on top of the nozzle 102 and one on the bottom) known as parallelogram linkages. The links 202A and 208A, the top portion of the trim support between the axes 222 and 236, and the top portion of the steering nozzle 102 between axes 222 and 226 form the four bars of the top four bar linkage. Similarly, the links 202B and 208B, the bottom portion of the trim support between the axes 222 and 236, and the bottom portion of the steering nozzle 102 between axes 222 and 226 form the four bars of the bottom four bar linkage. As previously mentioned, it is contemplated that only one four bar linkage could be provided.

In the prior art, the length of the lever arm used to rotate the steering nozzle would have corresponded to the distance from the axis 222 to an axis parallel to axis 222 passing through the point 207. In the present embodiment, the length of the lever arm used to rotate the steering nozzle 102 corresponds to the distance from the axis 236 to the axis passing through the point 207. As can be seen, the distance between the axis 236 and the axis passing through the point 207 is smaller than the distance between the axis 222 and the axis passing through the point 207. This, as explained in greater detail below, increases the degree of rotation of the steering nozzle 102 for a given amount of rotation of the steering input device compared to that provided by the previously described prior art system. Modifying the distance between the axis 236 and the axis passing through point 207 determines how much the rotation is increased compared to the prior art system. It is contemplated that for some applications it may be desirable to decrease the degree of rotation of the steering nozzle 102 for a given amount of rotation of the steering input device compared to that provided by the previously described prior art system. In such a case, the distance between the axis 236 and the axis passing through the point 207 would be greater than the distance between the axis about which the steering nozzle pivots and the point to which the push-pull cable connects to the steering arm in the prior art.

Although the illustrated embodiment uses parallelogram linkages it is contemplated that other types of four bar linkages could be used. For example, opposite sides of the linkages could have different lengths and be non-parallel, to form a trapezoid for example, thus resulting in a different rotation of the steering nozzle than when using the parallelogram linkages. By arranging the links to form a trapezoid, the tendency of some watercraft to want to steer in one direction due to the momentum of the rotating components of the engine and the propulsion system can be compensated. It is also contemplated that a four bar linkage with a sliding member could be used. In a four bar linkage with a sliding member, one of the links is replaced by a circular slot having a radius equivalent to the length of the link being replaced. It is also contemplated that one or more of the connections between the links could include a slot to provide some lost motion (i.e. to provide for translation of the connection point before the motion of one of the links is transmitted to the other link connected at that point). This lost motion could be provided for near neutral positions of the steering assembly such that minor movements away from a perfectly neutral position of the steering input device by the driver of the watercraft do not result in the watercraft being steered. It is also contemplated that the linkages could be disposed on the laterally opposite side of the steering nozzle assembly 200 from what is shown in the figures.

Figure 10:
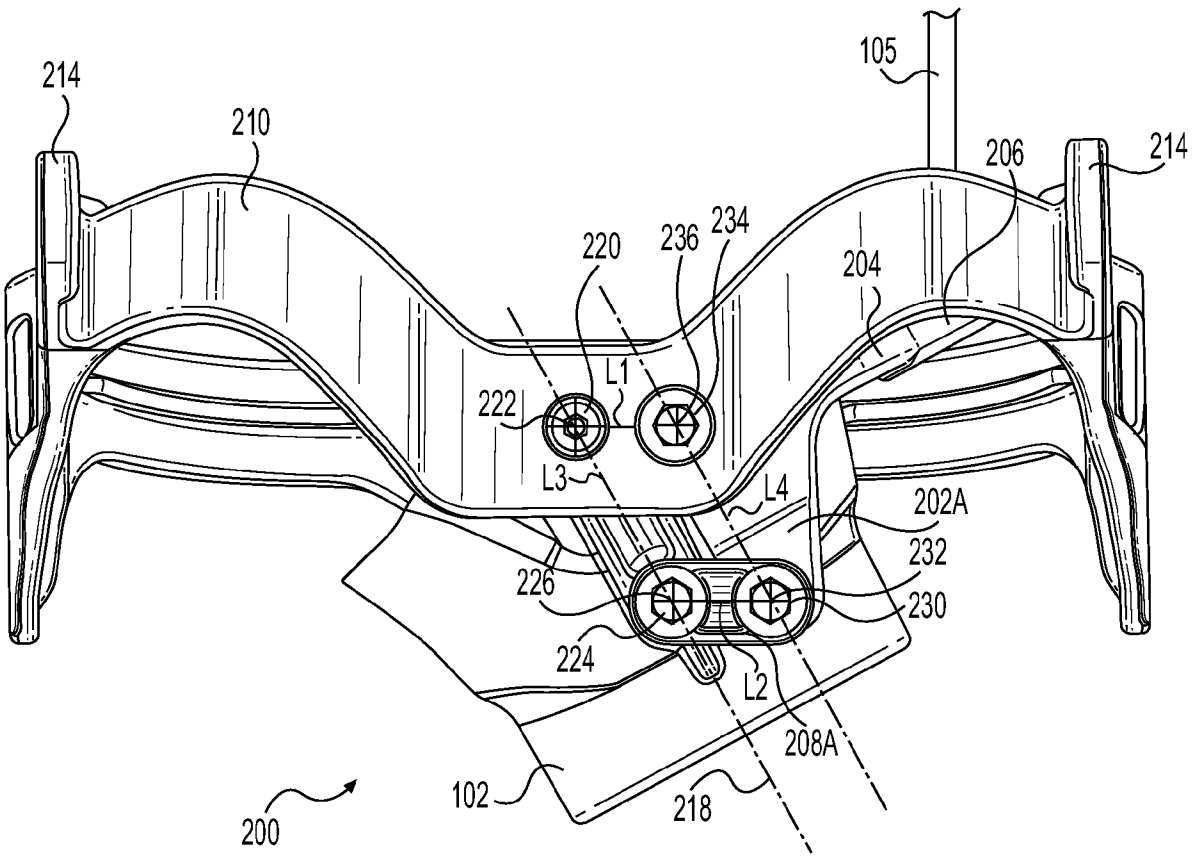
FIG. 10 is a top plan view of the steering nozzle assembly and the trim support of FIG. 9 as arranged when the watercraft or jet boat is being steered towards the right.

When the driver of the watercraft turns the steering input device to make a right turn, the push-pull cable 105 (or other steering actuator) pulls the steering arm 206 towards a front of the watercraft as shown in FIG. 10. This causes the steering arm 206, the bracket 204, and the links 202A and 202B to rotate in a counter-clockwise direction (as seen in FIG. 10) about the axis 236. The links 202A and 202B pull on the links 208A and 208B respectively, which in turn pull on the steering nozzle 102 causing it to rotate in a counter-clockwise direction about the axis 222. Therefore, the jet of water being expelled from the venturi 100 is redirected towards the right of the watercraft which causes the watercraft to turn right.

Similarly, when the driver of the watercraft turns the steering input device to make a left turn, the push-pull cable 105 pushes the steering arm 206 away from the front of the watercraft as shown in FIG. 11. This causes the steering arm 206, the bracket 204, and the links 202A and 202B to rotate in a clockwise direction (as seen in FIG. 11) about the axis 236. The links 202A and 202B push on the links 208A and 208B respectively, which in turn push on the steering nozzle 102 causing it to rotate in a clockwise direction about the axis 222. Therefore, the jet of water being expelled from the venturi 100 is redirected towards the left of the watercraft which causes the watercraft to turn left.

Figure 13A:
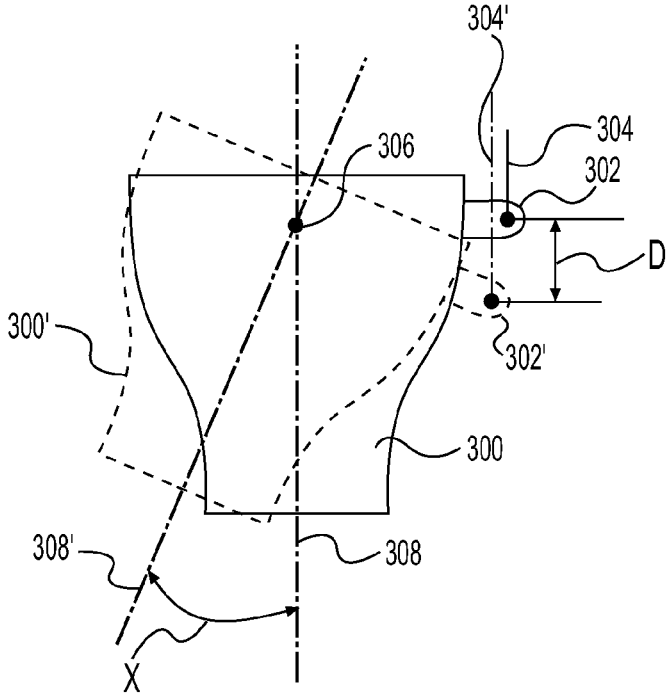
FIG. 13A PRIOR ART
FIG. 13A is a schematic drawing illustrating the movement of a prior art steering nozzle assembly.
Figure 13B:
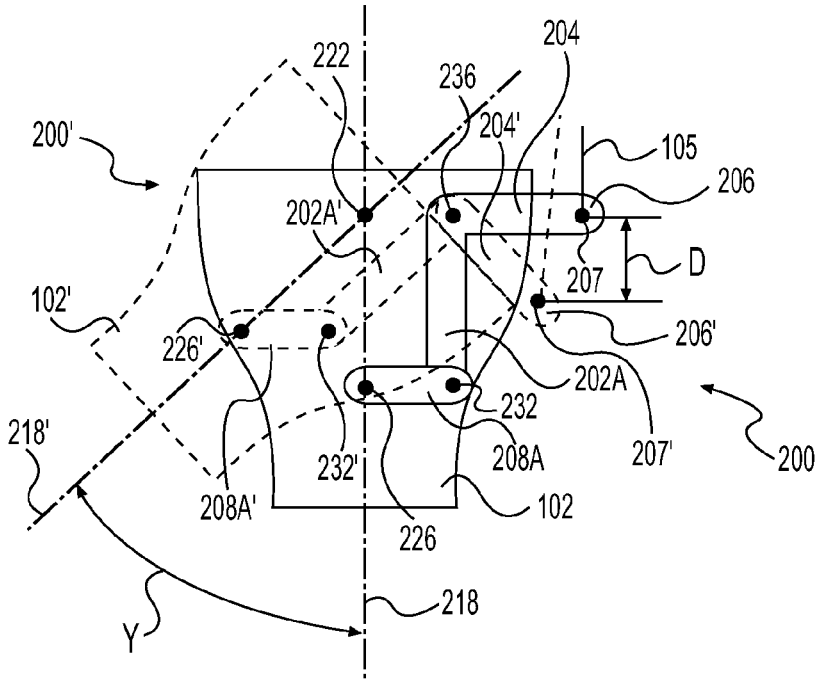
FIG. 13B is a schematic drawing illustrating the movement of the steering nozzle assembly of FIG. 9.

As can be seen in the schematic representation of the steering nozzle assembly 200 shown in FIG. 13B, when the push-pull cable 105 translates by a distance D, the steering nozzle 102 rotates by an angle Y. Note that for simplicity, in FIG. 13B, elements of the steering assembly 200 shown in their rotated position have been drawn in dotted lines and have been labelled with the same reference number with the addition of a prime. For example the steering nozzle 102 is labelled 102' in its rotated position. As can be seen by comparing the prior art steering nozzle assembly shown in FIG. 13A with the steering nozzle assembly 200 in FIG. 13B, for the same amount of translation of the push-pull cable (i.e. by a distance D), and therefore for the same amount of rotation of the steering input device by the driver of the watercraft, the steering nozzle 102 of the steering nozzle assembly 200 rotates by a greater angle than the steering nozzle 300 of the prior art (i.e. angle Y is greater than angle X). Thus, the present steering nozzle assembly 200 results in an increased responsiveness of the steering system of the watercraft when compared to the prior art. The present steering nozzle assembly 200 also has the added benefit of increasing the maximum angle of rotation of the steering nozzle 102 when compared to the prior art system described (assuming that the maximum amount of translation of the push-pull cable is the same in both systems).

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A watercraft comprising:

a hull;

a deck disposed on the hull;

an engine supported by the hull;

a jet pump connected to the hull and being operatively connected to the engine;

a venturi connected to the jet pump;

a steering nozzle rotationally mounted relative to the venturi about a first axis, the steering nozzle having a central longitudinal axis, the first axis intersecting the central longitudinal axis;

a first link having a first end rotationally mounted relative to the venturi about a second axis, the first link having a second end disposed generally rearwardly from the first end of the first link;

a second link having a first end rotationally mounted to the first link about a third axis and a second end rotationally mounted to the steering nozzle about a fourth axis, the third axis intersecting the second end of the first link, the second axis and the third axis being disposed on a same side of the central longitudinal axis;

a steering arm connected to the first link; and a steering assembly disposed at least in part on the deck and being operatively connected to the steering arm for rotating the steering nozzle relative to the venturi about the first axis, the first, second, third, and fourth axes being generally parallel to each other.

2. The watercraft of claim 1, wherein the fourth axis intersects the central longitudinal axis.

3. The watercraft of claim 1, wherein a distance from the first axis to the second axis is equal to a distance from the third axis to the fourth axis regardless of a position of the steering nozzle relative to the venturi;

wherein a distance from the first axis to the fourth axis is equal to a distance from the second axis to the third axis regardless of the position of the steering nozzle relative to the venturi;

wherein a line passing through the first and second axes is parallel to a line passing through the third and fourth axes regardless of the position of the steering nozzle relative to the venturi; and wherein a line passing through the first and fourth axes is parallel to a line passing through the second and third axes regardless of the position of the steering nozzle relative to the venturi.

4. The watercraft of claim 1, wherein the steering assembly is operatively connected to the steering arm at a point; and wherein a distance from the second axis to an axis parallel to the second axis and passing through the point is smaller than a distance from the first axis to the axis passing through the point.

5. The watercraft of claim 1, further comprising a bracket mounted to one of the jet pump, the venturi, and the hull; and wherein the steering nozzle is rotationally mounted to the bracket about the first axis and the first end of the first link is rotationally mounted to the bracket about the second axis.

6. The watercraft of claim 5, wherein the bracket is a trim support rotationally mounted relative to the venturi about a trim axis, the trim axis extending generally laterally and horizontally; and wherein the first, second, third, and fourth axes are rotatable about the trim axis with the trim support.

7. The watercraft of claim 6, wherein the bracket is a first bracket;

further comprising a second bracket rotationally mounted to the first bracket about the second axis; and wherein the first link and the steering arm are connected to the second bracket.

8. The watercraft of claim 1, wherein the first and second links are disposed generally vertically above the steering nozzle; and further comprising:

a third link having a first end rotationally mounted relative to the venturi about the second axis, the third link having a second end disposed generally rearwardly from the first end of the third link; and a fourth link having a first end rotationally mounted to the third link about the third axis and a second end rotationally mounted to the steering nozzle about the fourth axis; and wherein the third and fourth links are disposed generally vertically below the steering nozzle.

9. The watercraft of claim 8, further comprising a bracket rotationally mounted relative to the venturi about the second axis; and wherein the first link, the third link, and the steering arm are connected to the bracket.

10. The watercraft of claim 9, wherein the first link, the third link, and the steering arm are integrally formed.

11. The watercraft of claim 1, further comprising a bracket rotationally mounted relative to the venturi about the second axis; and wherein the first link and the steering arm are connected to the bracket.

12. A marine jet propulsion system comprising:

a jet pump;

a venturi connected to the jet pump;

a steering nozzle rotationally mounted relative to the venturi about a first axis, the steering nozzle having a central longitudinal axis, the first axis intersecting the central longitudinal axis;

a first link having a first end rotationally mounted relative to the venturi about a second axis, the first link having a second end disposed generally rearwardly from the first end of the first link;

a second link having a first end rotationally mounted to the first link about a third axis and a second end rotationally mounted to the steering nozzle about a fourth axis, the third axis intersecting the second end of the first link, the second axis and the third axis being disposed on a same side of the central longitudinal axis; and a steering arm connected to the first link, the first, second, third, and fourth axes being generally parallel to each other.

13. The jet propulsion system of claim 12, wherein the fourth axis intersects the central longitudinal axis.

14. The jet propulsion system of claim 12, wherein a distance from the first axis to the second axis is equal to a distance from the third axis to the fourth axis regardless of a position of the steering nozzle relative to the venturi;

wherein a distance from the first axis to the fourth axis is equal to a distance from the second axis to the third axis regardless of the position of the steering nozzle relative to the venturi;

wherein a line passing through the first and second axes is parallel to a line passing through the third and fourth axes regardless of the position of the steering nozzle relative to the venturi; and wherein a line passing through the first and fourth axes is parallel to a line passing through the second and third axes regardless of the position of the steering nozzle relative to the venturi.

15. The jet propulsion system of claim 12, wherein the steering arm has a point for operatively connecting the steering arm to a steering assembly of a watercraft; and wherein a distance from the second axis to an axis parallel to the second axis and passing through the point is smaller than a distance from the first axis to the axis passing through the point.

16. The jet propulsion system of claim 12, further comprising a trim support rotationally mounted relative to the venturi about a trim axis, the trim axis extending generally laterally and horizontally;

wherein the steering nozzle is rotationally mounted to the bracket about the first axis and the first end of the first link is rotationally mounted to the bracket about the second axis; and wherein the first, second, third, and fourth axes are rotatable about the trim axis with the trim support.

17. The jet propulsion system of claim 12, wherein the first and second links are disposed generally vertically above the steering nozzle; and further comprising:

a third link having a first end rotationally mounted relative to the venturi about the second axis, the third link having a second end disposed generally rearwardly from the first end of the third link; and a fourth link having a first end rotationally mounted to the third link about the third axis and a second end rotationally mounted to the steering nozzle about the fourth axis; and wherein the third and fourth links are disposed generally vertically below the steering nozzle.

18. The jet propulsion system of claim 12, further comprising a bracket rotationally mounted relative to the venturi about the second axis; and wherein the first link and the steering arm are connected to the bracket.

19. A marine jet propulsion system comprising:

a jet pump;

a venturi connected to the jet pump;

a steering nozzle rotationally mounted relative to the venturi;

a four bar linkage connecting the steering nozzle to the venturi, the four bar linkage being a parallelogram linkage; and a steering arm connected to the four bar linkage.

* * * * *